US005323506A

United States Patent [19]

Babitch

[11] Patent Number: 5,323,506

[45] Date of Patent: Jun. 28, 1994

[54] BATHTUB SCRUBBING IMPLEMENT

[76] Inventor: Bob A. Babitch, 20109 Deering, Livonia, Mich. 48152-2311

[21] Appl. No.: 63,547

[22] Filed: May 19, 1993

[51] Int. Cl.[5] ..... A47L 13/10

[52] U.S. Cl. ..... 15/210.1; 15/176.3; 15/176.6; 15/228; 15/244.1

[58] Field of Search ..... 15/209.1, 210.1, 228, 15/229.11, 229.13, 244.1-244.3, 160, 176.1, 176.3-176.6

[56] References Cited

U.S. PATENT DOCUMENTS

| | | | |
|---|---|---|---|
| D. 247,075 | 1/1978 | Krusche . | |
| D. 288,138 | 2/1987 | Smith . | |
| D. 304,630 | 11/1989 | Jones et al. . | |
| 1,509,381 | 9/1924 | Townsend | 15/210.1 |
| 2,739,333 | 3/1956 | Harris | 15/229.13 |
| 2,845,642 | 8/1958 | Inman | 15/176.6 |
| 3,056,987 | 10/1962 | Lieberman et al. | 15/210.1 |
| 3,090,985 | 5/1963 | Baum . | |
| 3,214,779 | 11/1965 | Wheeler . | |
| 3,345,669 | 10/1967 | Starry . | |
| 3,359,589 | 12/1967 | Moore | 15/210.1 |
| 3,369,268 | 2/1968 | Burns et al. | 15/210.1 |
| 3,388,415 | 6/1968 | Warner et al. | 15/210.1 |
| 3,599,265 | 8/1971 | D'Ercoli et al. | 15/210.1 |
| 3,605,165 | 9/1971 | Burns | 15/210.1 |
| 3,713,744 | 1/1973 | Sims | 15/210.1 |
| 3,720,976 | 3/1973 | Bailey | 15/244.2 |
| 3,820,187 | 6/1974 | Numbers et al. | 15/244.2 |
| 4,032,239 | 6/1977 | Maupin | 15/228 |
| 4,134,173 | 1/1979 | Cupp et al. | 15/210.1 |
| 4,155,140 | 5/1979 | Janssen et al. | 15/210.1 |
| 4,315,342 | 2/1982 | Ash | 15/244.1 |
| 4,819,294 | 4/1989 | Calvert | 15/210.1 |
| 5,052,840 | 10/1991 | St. Cyer | 15/244.1 |

OTHER PUBLICATIONS

Form No. 303A, Household Brushes and Brooms Nov. 2, 1987, p. 3, #855; Kellogg Brush Mfg. Co.

*Primary Examiner*—Harvey C. Hornsby
*Assistant Examiner*—Mark Spisich
*Attorney, Agent, or Firm*—Krass & Young

[57] ABSTRACT

A bathtub scrubbing implement for efficiently and effectively cleaning the interior surface of a bathtub providing a scrubber head having at least one substantially planar side conformable to the planar surfaces of a bathtub interior and at least one curved side conformable to the curves of a bathtub interior. In the preferred embodiment, the scrubbing implement includes a base, an elongated handle, and a trapezoid-shaped scrubber head encased in a scrubber material. The scrubber head is detachable and interchangeable with other scrubber heads constructed in accordance with the present invention to provide choice of scrubber materials. The scrubbing implement improves reach during use without compromising appropriate leverage and stable thrust, thus providing greater manipulability. The scrubbing implement may be used swiftly and reliably, and is easily guided even in aggressive operation. Optionally, the handle may also provide a hook for convenient storage over a shower head, curtain rod, or wall-hook.

10 Claims, 3 Drawing Sheets

36
74b
38
34
32
10
14

26
44
30
40
22
12
20
16
24
42

46
44
42
14
40
46a
18

22
26
14
12
46b
18
56
46a
62
16
42

10
12
14
16
18
20
22
24
26
28a
28b
34
36
38
40
42
44
46
46a
46b
48
50a
52
60
62
64a
64b
70
72
74a
74b
82a
82b
A
A'
B
B'

BATHTUB SCRUBBING IMPLEMENT

FIELD OF THE INVENTION

This invention relates generally to cleaning implements such as mops, brushes, sponges, and scrubbers, and specifically relates to an improved bathtub scrubbing implement having detachable scrubber heads, each of said heads having at least a first surface shape conformable to the curves of a bathtub and at least a second surface shape conformable to the planar surfaces of a bathtub.

BACKGROUND OF THE INVENTION

For as long as there have been bathtubs, the removal of accumulated soap scum, dirt and/or mildew from the interior surface of the bathtub has been a difficult and unsavory chore. The interior shape and curvature of the bathtub contributes to the difficult nature of the task as does the fact that bathtubs are often surrounded on three sides by walls.

Heretofore, scrub brushes and other cleaning implements have not effectively combined efficient bathtub scouring motion with relatively even distribution of leverage, stable thrust and application of cleaning force. For example, U.S. Pat. No. 3,214,779 of Wheeler discloses a bathtub cleaning device which includes a pair of narrow resilient members secured to the upper surface of a sponge. However, the narrow resilient members of the Wheeler device support only a small percentage of the surface area of the sponge, causing uneven distribution of the cleaning force applied over the entire surface area of the sponge resulting in uneven cleaning.

Furthermore, brushes or mops that do not employ both rounded and flat scrubbing surfaces with a rigid support structure underlying the entire surface area of the scrubber material lack certainty of scouring potential.

Accordingly, there is a need in the art for a scrubbing implement which is (1) inexpensive, (2) structurally sound with efficient leverage to accommodate stable thrusting cleaning movements, (3) simple and comfortable to use, (4) able to effectively clean enclosure surfaces which are cumbersome to reach from alongside the bathtub, (5) provided with detachable, replaceable scrubber heads that provide choices as to scrubber materials selected for addressing a plurality of surfaces to be cleaned in a variety of cleaning situations, and (6) adapted to cleanse both curved or right-angle edges adjacent flat surfaces by means of a plurality of scrubber head surface shapes which conform to the curves, corners and flat surfaces of a bathtub.

SUMMARY OF THE INVENTION

Disclosed and claimed herein is a scrubbing implement suited for cleaning surfaces which are difficult or awkward to reach and/or approach such as the curved sides and enclosure walls of a bathtub's interior, especially when the bathtub abuts three walls. The bathtub scrubbing implement includes a detachable scrubber head having at least a first surface conformable to the curves of a bathtub and at least a second surface conformable to the planar surfaces of a bathtub.

In the preferred embodiment, the scrubbing implement of the present invention has a rigid scrubber head in the shape of a trapezoid having a substantially planar bottom, a front, a back, and two opposed sides which taper inwardly from the back to the front of the scrubber head. The scrubber head is slidably mounted and retained on a base having a substantially planar bottom and top, a front, a back and two opposed sides. An elongated handle having a first end and a second end is attached to and extends from the base at an angle between zero degrees and ninety degrees. The front and two opposed sides of the trapezoid-shaped scrubber head have curved outer surfaces and extend upward from the bottom of the scrubber head and overlap at least a portion of the top of the base. The front and sides of the scrubber head are rounded to conform to curved surfaces and the bottom of the scrubber head is substantially flat to conform to substantially planar surfaces.

A scrubber material is affixed to the curved outer surfaces of the front and sides of the scrubber head as well as to the bottom of the scrubber head. A variety of materials may be affixed to the scrubber head to correspond to different cleaning situations. For example, a sponge-like scrubber material may be used for light cleaning or a more abrasive scouring-pad-like scrubber material may be used for more vigorous cleaning. In the preferred embodiment, the scrubber head is detachable, therefore enabling the interchangeability of different scrubber heads with different scrubber materials to accommodate the particular cleaning situation at hand. Alternatively, the scrubber material itself may be detachable from the scrubber head and interchangeable.

In addition, the scrubbing implement may incorporate a variety of means, singularly or in combination, to more securely retain the base within the scrubber head. For example, the scrubber head may include a pair of opposed inverted ledges extending lengthwise along the cavity-facing surface of the opposed sides which correspond with a pair of opposed protruding ridges extending lengthwise along the outer surface of the opposed sides of the base; likewise, a tooth may protrude from the cavity-facing surface of the bottom of the scrubber head which corresponds with a hollow notch in the bottom of the base. Thus, when the base is positioned within the scrubber head, the ledges and ridges fit together and the tooth fits in the hollow notch to securely hold the base and scrubber head together. For more vigorous scrubbing situations, a fastening means such as a screw may be further provided and positioned through apertures extending through the base and a portion of the scrubber head for added security.

Furthermore, in a preferred embodiment, the elongated handle includes a grip portion proximate the second end of the handle which has a substantially flat top, a substantially flat bottom and two opposed outwardly curved sides. A plurality of longitudinally-oriented flute disposed along the two opposed outwardly curved sides of the grip portion may also be incorporated to facilitate the user's grip on the handle of the scrubbing implement. Optionally, a hook may also be provided proximate the second end of the handle for hanging the scrubbing implement over a shower curtain rod or wall-peg when not in use.

The scrubbing implement of the present invention may be used to clean the corresponding curves and flat surfaces of the interior surface area of a bathtub. Although the curved outer surfaces of the front and opposed sides of the scrubber head are preferably conformable to the curves of a bathtub, the scrubbing implement may be used on other surfaces as well.

BRIEF DESCRIPTION OF THE DRAWINGS

The following detailed description is best understood with reference to the following drawings, in which.

DETAILED DESCRIPTION OF THE DRAWINGS

Figures 1, 4, 5:
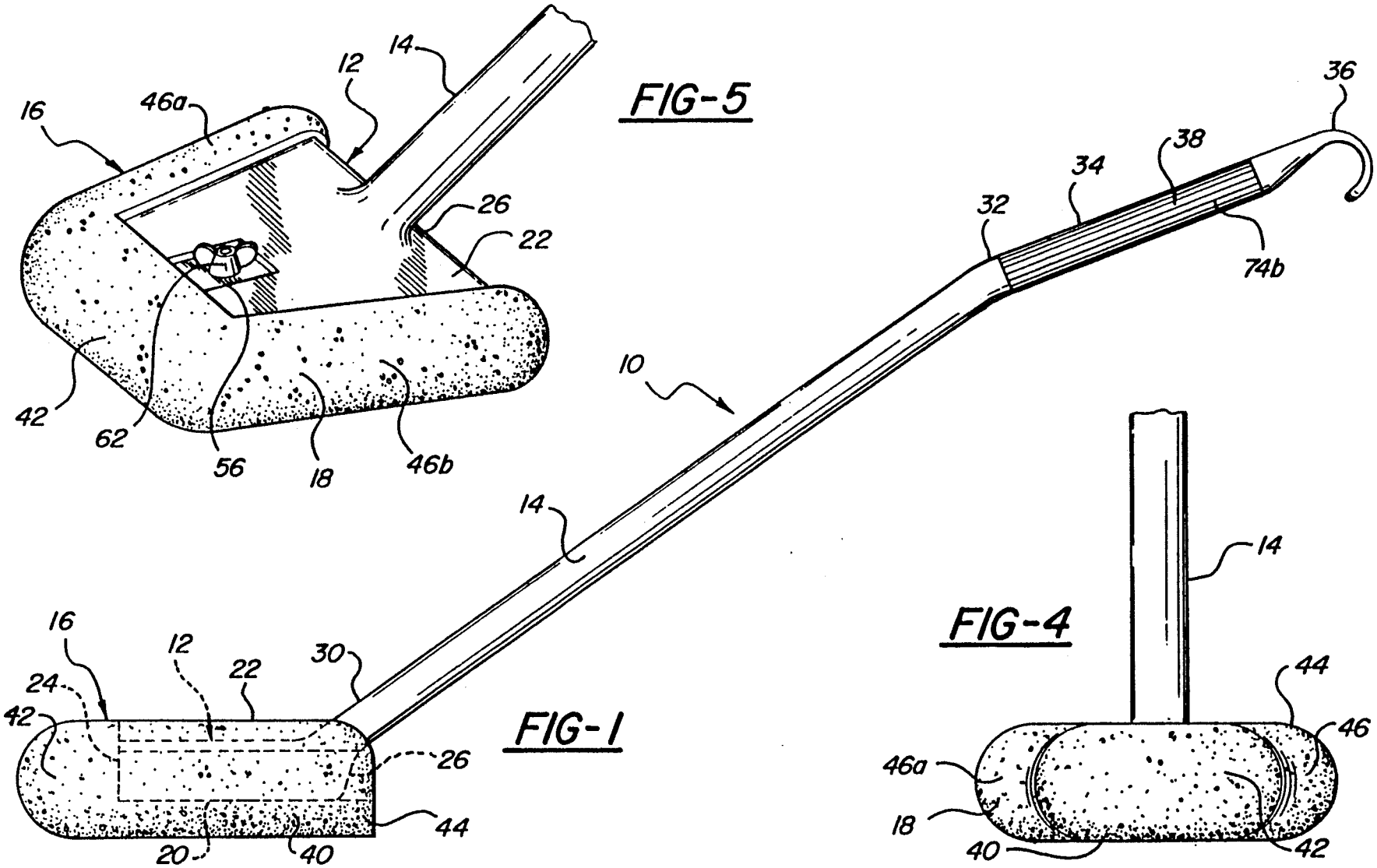
FIG. 1 is a side view of a scrubbing implement constructed in accordance with the teachings of the present invention.
FIG. 4 is a front view of the scrubbing implement shown in FIG. 2.
FIG. 5 is a perspective view of the scrubbing implement shown in FIG. 2.

Throughout the following detailed description, like reference numerals are used to refer to the same element of the invention shown in multiple figures thereof. Referring now to the drawings, and in particular to FIGS. 1-5, there is shown a bathtub scrubbing implement 10 according to the present invention. The scrubbing implement 10 includes a scrubber head 16 having at least a first surface shape conformable to the curves of a bathtub and at least a second surface shape conformable to the planar surfaces of the bathtub. In the preferred embodiment, the scrubbing implement 10 includes a base 12, an elongated handle 14, a detachable rigid scrubber head 16 in the shape of a trapezoid, and a scrubber material 18.

The base 12 of the bathtub scrubbing implement 10 has a substantially planar bottom 20, a substantially planar top 22, a front 24, a back 26, and two opposed sides 28*a*, 28*b*. The base 12 is configured to be snugly and securely retained in the scrubber head 16 when the scrubbing implement 10 is in use.

Figure 11:
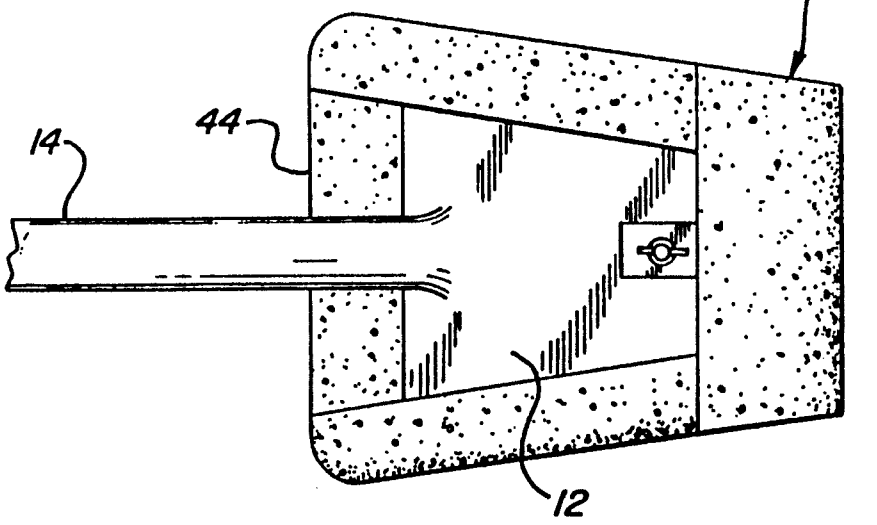
FIG. 11 is a top view of the scrubber head of the present invention as shown in FIG. 10.
Figure 8:
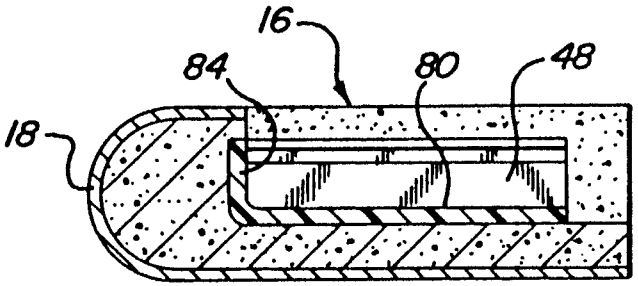
FIG. 8 is a cross-sectional view of the scrubber head of the present invention taken along line B—B' as shown in FIG. 3.

Scrubber head 16 is provided with a substantially planar bottom 40, a front 42, a back 44, and two opposed sides 46*a*, 46*b*. In the preferred embodiment, the opposed sides 46*a*, 46*b* taper inwardly from the back 44 to the front 42 to form the non-parallel sides of the trapezoid-shaped scrubber head 16. The front 42 and the opposed sides 46*a*, 46*b* extend upward from the bottom 40 to define a cavity 48, best shown in FIGS. 7 and 8. The front 42 has a cavity facing surface 84, the bottom 40 has a cavity facing surface 80 and the opposed sides 46*a*, 46*b* have cavity facing surfaces 82*a*, 82*b*. The cavity 48 is configured to slidably receive and retain the base 12. The front 42 and the opposed sides 46*a*, 46*b* of the scrubber head 16 extend over at least a portion of the top 22 of the base 12 when the base 12 is positioned within the cavity 48. FIG. 11 illustrates an alternative embodiment of the scrubber head 16 of the present invention wherein the back 44 of the scrubber head 16 also extends over a portion of the top 22 of the base 12. The portions of the scrubber head 16 which extend over the top 22 of the base 12 may also be used to clean the tub surface when encased in scrubber material 18, thus increasing the functional surface area of the scrubbing implement 10. The scrubber head 16 is preferably detachable from the base 12 and interchangeable other scrubber heads 16 constructed in accordance with the present invention.

The front 42 and the opposed sides 46*a*, 46*b* have curved outer surfaces which are conformable to the curves of a bathtub. For example, the sides 46*a*, 46*b* conforms best to the four interior, corner-curves of a bathtub, and the front 42 conforms best to the interior, oval-shaped curve formed by a bathtub bottom where it meets the interior bathtub sides and ends. The scrubber head 16 is preferably constructed of a plastic such as polyethylene or any other suitable and rigid material such as wood or metal.

A scrubber material 18 is affixed to the curved outer surfaces of the front 42 and the sides 46*a*,46*b* of the scrubber head 16 and to the bottom 40 of said scrubber head 16. The scrubber material 18 may vary depending upon the type of cleaning situation. For example, for lighter cleaning situations, the scrubber material 18 may be a sponge, preferably of cellulose, polyurethane, natural sponge, or any other suitable material. For more vigorous cleaning, scrubber material 18 is preferably a scouring pad of the type known in the art for use in scrubbers or any other suitable material or materials. The scrubber material 18 is attached to the rigid trapezoid-shaped scrubber head 16 which provides the scrubber material 18 with a sturdy support structure which is specifically curved and otherwise shaped to accommodate the interior surfaces of a bathtub. The scrubber material 18 may be form-fitted and waterproof glued to the scrubber head 16 or it may be detachable from the scrubber head 16 to facilitate easy replacement when the scrubber material 18 is depleted or distorted.

Figure 9:
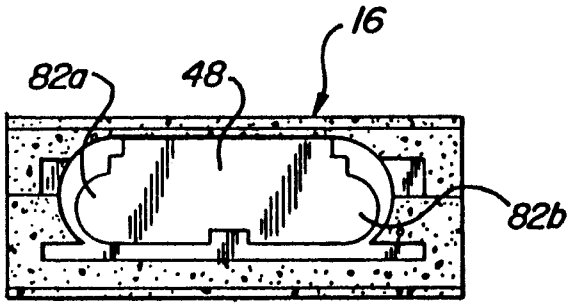
FIG. 9 is a cross-sectional view of another embodiment of the scrubber head of the present invention.

Because of the underlying rigid support structure provided by the scrubber head 16 it is not necessary that the scrubber material 18 be form-fitted to the scrubber head 16 to benefit from the curvature and shape of the scrubber head 16. For example, in an alternative embodiment, the scrubber material 18 may be a sponge in the shape of a rectangle which is affixed to the scrubber head 16. When cleaning the curved areas of the bathtub interior, the flexibility of the sponge allows it to readily conform itself to the underlying rigid trapezoid-shaped support structure of the scrubber head 16 to facilitate cleaning. It should be noted that in FIGS. 1 through 5 that the scrubber head 16 is shown encased in scrubber material 18. FIG. 7 illustrates the rigid underlying structure of the scrubber head 16 in conjunction with the scrubber material 18, as does FIG. 9 which is a cross-sectional view of an alternative embodiment of the scrubber head 16 of the present invention.

As best shown in FIG. 7, the scrubber head 16 may further include a pair of opposed inverted ledges 50*a*, 50*b* extending lengthwise along the cavity-facing surface 82*a*, 82*b* of each opposed side 46*a*,46*b* of the scrubber head 16 and a tooth 52 protruding from the cavity-facing surface 80 of the bottom 40 of said scrubber head 16. As shown in FIG. 6, corresponding to the location of said inverted ledges 50a,50b when said base 12 is positioned in the cavity 48 of the scrubber head 16, a pair of protruding ridges 64a,64b extend lengthwise along the outer surface of each opposed side 28a,28b of the base 12; likewise, a hollow notch 60 is located in the bottom 20 of the base 12 to correspond to the location of the tooth 52. Thus, when said base 12 is positioned within the cavity 48 of the scrubber head 16, the pair of inverted ledges 50a,50b and the pair of protruding ridges 64a, 64b are slidably engaged and maintain a positional relationship. Likewise, there is room and enough flexibility of scrubber head 16 to provide enough give for tooth 52 to frictionably slide across the bottom 20 of base 12, fore to aft. Tooth 52 then frictionably nests in notch 60 which conforms to tooth 52. Thus, the tooth 52 and the notch 60 also engage and maintain positional relationship to securely retain the base 12 in the scrubber head 16 during use.

Figure 10:
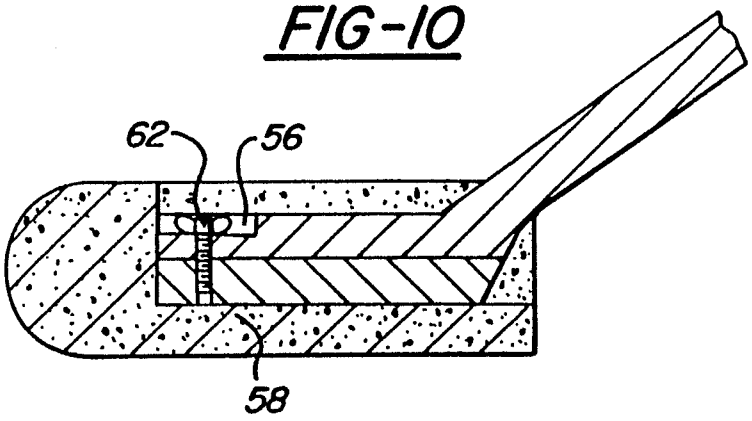
FIG. 10 is a cross-sectional view of an alternative embodiment of the present invention.

For more vigorous cleaning and rapid scouring motion, the bathtub scrubbing implement 10 may further include a fastening means 62 to even more securely retain the base 12 in the scrubber head 16. As best shown in FIG. 10, first aperture 56 is provided in the top 22 of the base 12 which extends through the bottom 20 of the base 12. A second aperture 58 is provided in the cavity-facing surface 80 of the bottom 40 of the scrubber head 16 to correspond to the location of the first aperture 56 such that when the base 12 is positioned within the cavity 48 of the scrubber head 16 the first aperture 56 and the second aperture 58 are in alignment. Fastening means 62 is then positioned in and through the first aperture 56 and the second aperture 58 to securely retain the base 12 within the scrubber head 16. In the preferred embodiment, fastening means 62 is a screw, but other fasteners such as cotter pins or pegs may be equally suitable for the intended purpose.

The elongated handle 14 of the present invention has a first end 30 and a second end 32. The first end 30 of the handle 1 is attached to and extends from the base 12 at a nonperpendicular angle. Preferably, the handle 14 extends from either the top 22 or the back 26 of the base 12 at an angle not greater than ninety degrees. The handle 14 of the bathtub scrubbing implement 10 may further include an angled grip portion 34 attached to the second end 32 of the handle 14. Preferable, the grip portion 34 has a substantially flat top 70, a substantially, flat bottom 72 and two opposed outwardly curved sides 74a,74b. A plurality of longitudinally-oriented flutes 38 may be disposed along the two opposed outwardly curved sides 74a,74b of said grip portion 34 in mirror image to facilitate the ability of the user to maintain a firm grasp on the handle 14. Also, easier hand-gripping is provided by the substantially flat and smooth surfaces of the opposing top 70 and bottom 72 sides of the grip portion 34. In the preferred embodiment, the base 12, the handle 14, the grip portion 34 and the flutes 38 are integrally formed, all of one piece. The effect of the angles of handle 14 makes for ease of manipulation while reaching all bathtub surfaces. Handle 14 may be turned so its side faces the interior corner-curves of a bathtub for use with the curved sides of the scrubber head 16.

Figures 2, 3, 6, 7:
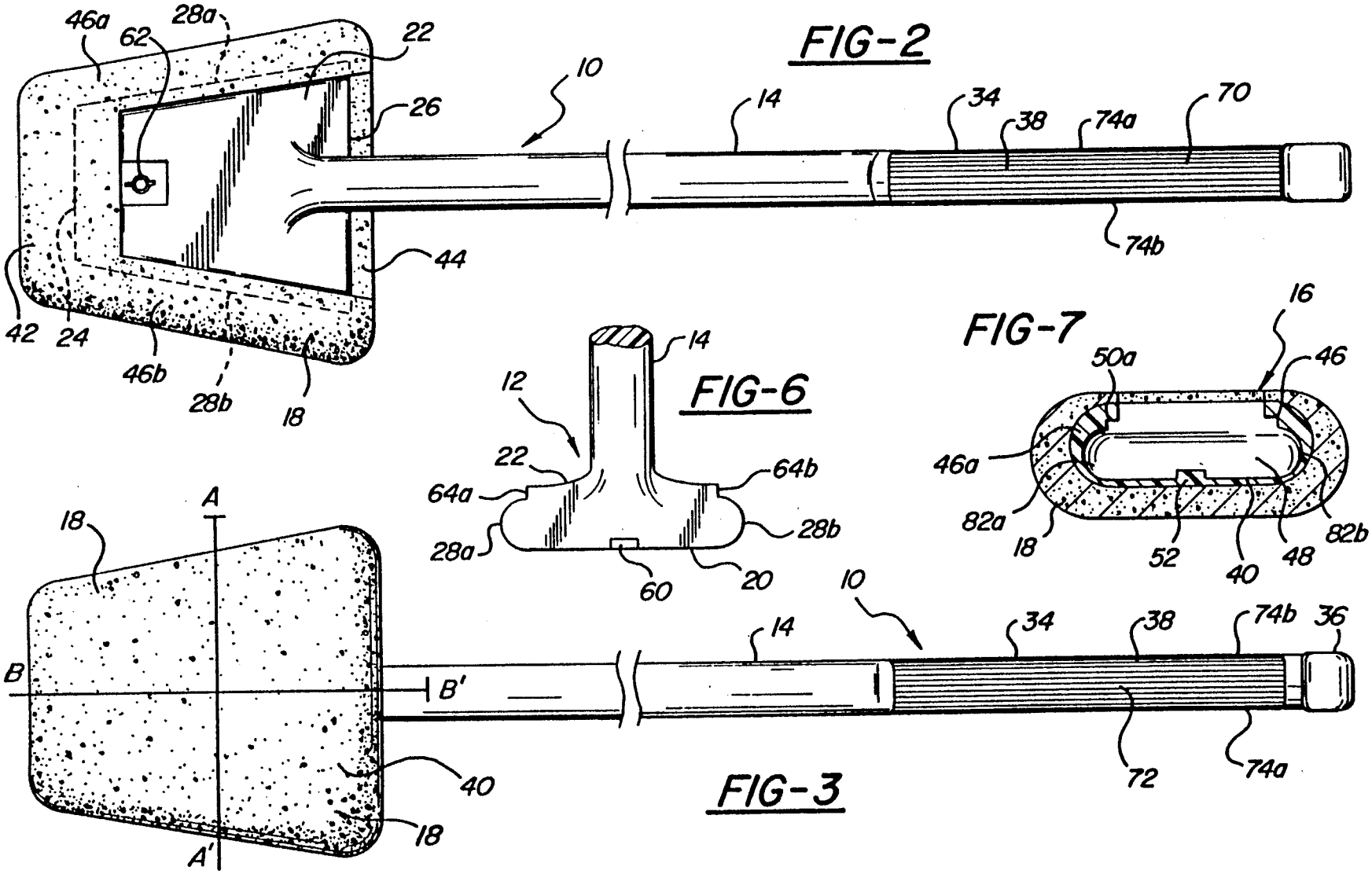
FIG. 2 is a top view of another embodiment of a scrubbing implement constructed in accordance with the teachings of the present invention.
FIG. 3 is a bottom view of the scrubbing implement shown in FIG. 2.
FIG. 6 is a rear view of an embodiment of the base of the scrubbing implement constructed in accordance with the teachings of the present invention.
FIG. 7 is a cross-sectional view of the scrubber head of the present invention taken along line A—' as shown in FIG. 3.

Optionally, as best illustrated in FIG. 1, a hook 36 may be provided for hanging the scrubbing implement 10 over a shower curtain rod or wall-peg when not in use. The elongated handle 14 of the present invention is preferably constructed of structural foam with talc, or plastic such as polyethylene, or any other suitable material.

In an alternative embodiment, not illustrated, the top 22 of the base 12 may slant upwardly in a wedge-like manner. Likewise, the scrubber head 16 is also wedge-shaped to extend over at least a portion of the top 22 of the base 12.

Control of the scouring motion of scrubbing implement 10 is addressed by several of the aforementioned elements. For example, the elongated handle 14 of the scrubbing implement 10 is proportioned to accord with productive, stable leveraging which is anatomically comfortable for the user. Additionally, the fact that the scrubber head 16 has a substantially flat bottom 40, a curved front 42, and curved sides 46a, 46b which generally conform with the internal curvature of a bathtub assists in the control of the scouring motion, thus enabling specific areas of the dirty surface to be targeted and efficiently and effectively cleaned. The tapered sides of the scrubber head 16 provide for additional leverage and comfort of use and manipulation in the four corner curves of a bathtub. Thus, those employing a scrubbing implement 10 produced in accordance with the current invention may so operate it such that the curved surfaces of the scrubber head 16 contact the curved surfaces of the interior of the bathtub, and the substantially planar bottom 40 of the scrubber head 16 contacts the sides and floor of the bathtub. Thus, the scrubber implement 10 provides efficacious cleaning power and convenience.

The bathtub scrubbing implement 10 of the present invention has been described and depicted with reference to certain embodiments and exemplifications thereof. Of course, one skilled in the art may be able to envision variations of the bathtub scrubbing implement without deviating from the scope of the invention. For purposes of example only and not intended as an all-inclusive list, the following variations of the present invention are possible: a multi-position handle to change angle perhaps for use in other applications; a pivoting handle with trigger release for more than one position; a trigger release/lock of the scrubber attachments; a ball and socket arrangement for various scrubbers; a hollow handle which supplies cleanser to the scrubber; a disposable scrubber which contains a cleanser agent, with or without trigger release; a telescoping handle; a two-headed handle; a curving or straight rather than angled handle; projections from the handle for added leverage; attachments and/or extensions for cleaning, dusting or scrubbing walls, ceilings, etc.; screw on/off attachments; shovel-type grip on the handle; clamp-on attachments; strap-on attachments, perhaps one similar to a fabric with multiple hooks attaching securely to a fabric in or on the handle; suction gripping attachments; and use of bristles.

Accordingly, the scope of the invention should not be determined by the embodiments and exemplifications depicted and described herein, but by the appended claims and all reasonable equivalents thereof.

I claim as follows:

1. A bathtub scrubbing implement comprising:

a base having a substantially planar bottom and a substantially planar top, said base further having a front, a back, and two opposed sides;

an elongated handle having a first end and a second end, the first end of said handle attached to and extending from said base at a nonperpendicular angle;

a rigid scrubber head in the shape of a trapezoid, said scrubber head having a substantially planar bottom, a front, a back, and two opposed sides, said sides tapering inwardly from said back to said front, said front and said sides extending upward from said bottom to define a cavity configured to slidably receive and retain said base such that said front and said sides of said scrubber head extend over at least a portion of said top of said base, said front, said bottom, and said sides having cavity-facing surfaces, and said front and said sides of said scrubber head further having curved outer surfaces, said curved outer surfaces conformable to the curves of a bathtub; and a scrubber material affixed to the curved outer surfaces of said front and said sides of said scrubber head, said scrubber material further affixed to the bottom of said scrubber head whereby the scrubbing implement may be used to clean the corresponding curves and flat surfaces of the interior surface area of a bathtub.

2. The bathtub scrubbing implement of claim 1 wherein said scrubber head is detachable from said base.

3. The bathtub scrubbing implement of claim 1 wherein said scrubber material is a scouring pad.

4. The bathtub scrubbing implement of claim 1 wherein said scrubber material is a sponge.

5. The bathtub scrubbing implement of claim 4 wherein said sponge is in the shape of a rectangle.

6. The bathtub scrubbing implement of claim 1 further comprising an angled grip portion attached to said second end of said handle, said grip portion having a substantially flat top, a substantially flat bottom and two opposed outwardly curved sides.

7. The bathtub scrubbing implement of claim 6 further comprising a plurality of longitudinally-oriented flutes disposed along said two opposed outwardly curved sides of said grip portion.

8. The bathtub scrubbing implement of claim 1 further comprising a hook attached proximate said second end of said handle whereby said hook may be used to hang said bathtub scrubbing implement when not in use.

9. The bathtub scrubbing implement of claim 1 further comprising:

a pair of inverted ledges extending lengthwise along the cavity-facing surface of each opposed side of the scrubber head;

a tooth protruding from the cavity-facing surface of the bottom of said scrubber head;

a pair of protruding ridges extending lengthwise along the outer surface of each opposed side of the base, the location of said protruding ridges corresponding to the location of said inverted ledges such that said ledges and said ridges engage and maintain positional relationship when said base is positioned in the cavity of said scrubber head; and a hollow notch in the bottom of said base, the location of said notch corresponding to the location of said tooth such that the tooth and the notch engage and maintain positional relationship when said base is positioned in the cavity of s id scrubber head whereby the base is securely retained within said scrubber head.

10. The bathtub scrubbing implement of claim 1 further comprising:

a first aperture in the top of the base extending through the bottom of the base;

a second aperture in the cavity-facing surface of the bottom of the scrubber head, the location of said second aperture corresponding to the location of said first aperture such that when the base is positioned within the cavity of the scrubber head the first aperture and the second aperture are in alignment; and a fastener disposed in said first and second apertures whereby the base is securely retained within said scrubber head.

* * * * *

UNITED STATES PATENT AND TRADEMARK OFFICE

CERTIFICATE OF CORRECTION

PATENT NO. : 5,323,506
DATED : June 28, 1994
INVENTOR(S) : Bob. A. Babitch

It is certified that error appears in the above-indentified patent and that said Letters Patent is hereby corrected as shown below:

Column 3, Line 21, please delete "A-'" and insert --A-A'--.

Column 5, Line 40, please delete "handle 1" and insert --handle 14--.

Column 8, Line 23, please delete "s id" and insert --said--.

Signed and Sealed this

Thirteenth Day of September, 1994

*Attest:*

*Attesting Officer*

BRUCE LEHMAN

*Commissioner of Patents and Trademarks*